US006206767B1

(12) United States Patent
Suzuki et al.

(10) Patent No.: US 6,206,767 B1
(45) Date of Patent: Mar. 27, 2001

(54) PLANETARY GEAR SYSTEM PARALLEL PLANER

(75) Inventors: Junpei Suzuki, Tokyo; Yutaka Kunii, Tochigi, both of (JP)

(73) Assignee: Hamai Co., Ltd., Tokyo (JP)

( * ) Notice: Subject to any disclaimer, the term of this patent is extended or adjusted under 35 U.S.C. 154(b) by 0 days.

(21) Appl. No.: 09/403,554

(22) PCT Filed: Aug. 3, 1999

(86) PCT No.: PCT/JP99/04170

§ 371 Date: Oct. 25, 1999

§ 102(e) Date: Oct. 25, 1999

(87) PCT Pub. No.: WO00/10771

PCT Pub. Date: Mar. 2, 2000

(30) Foreign Application Priority Data

Aug. 20, 1998 (JP) ..... 10-234553

(51) Int. Cl.[7] ..... B24B 7/00

(52) U.S. Cl. ..... 451/262; 451/288; 451/291; 451/285; 451/269

(58) Field of Search ..... 451/41, 63, 262, 451/268, 269, 285, 287, 288, 291, 397, 398

(56) References Cited

U.S. PATENT DOCUMENTS

| | | | | |
|---|---|---|---|---|
| 4,502,252 | * | 3/1985 | Iwabuchi | 451/269 |
| 4,674,236 | * | 6/1987 | Kawakami et al. | 451/56 |
| 4,773,185 | * | 9/1988 | Taira | 451/269 |
| 5,085,009 | * | 2/1992 | Kinumura et al. | 451/291 |
| 5,174,067 | * | 12/1992 | Hasegawa et al. | 451/291 |
| 5,422,316 | * | 6/1995 | Desai et al. | 451/28 |
| 5,980,366 | * | 11/1999 | Waddle et al. | 451/262 |
| 6,080,042 | * | 6/2000 | McGregor et al. | 451/41 |
| 6,113,490 | * | 9/2000 | Shunji | 451/288 |

* cited by examiner

*Primary Examiner*—Eileen P. Morgan
(74) *Attorney, Agent, or Firm*—Birch, Stewart, Kolasch & Birch, LLP

(57) ABSTRACT

A planetry-gear-type parallel-surface processing machine of the present invention improves the ability of an upper surface plate to follow matrials to be processed. A rotation preventing pin projects from the upper surface of the upper surface plate at a position near the outer periphery thereof, the rotation of the upper surface plate is prevented by abutting a stopper supported by a bracket disposed on a machine main body against a side of the rotation preventing pin, plural pulleys are disposed in a ring mounted to the upper surface plate and suspension plate, and an endless wire cable is stretched between the pulleys so as to support the vertical load of the upper surface plate.

2 Claims, 5 Drawing Sheets

PLANETARY GEAR SYSTEM PARALLEL PLANER

This application is the national phase under 35 U.S.C. §371 of PCT International Application No. PCT/JP99/04170 which has an International filing date of Aug. 3, 1999, which designated the United States of America.

BACKGROUND OF THE INVENTION

1. Field of the Invention

The present invention relates to a planetary-gear-type parallel-surface processing machine for performing surface processing such as lapping, polishing, and the like.

2. Description of the Related Art

FIG. 4 is a perspective view showing the main portion of a conventional 4-way-type parallel-surface processing machine, and FIG. 5 is a sectional view thereof. In the figures, numeral 1 denotes an annular lower surface plate rotated by a first drive unit (not shown), numeral 2 denotes carriers each having a toothed surface around the outer periphery thereof, numeral 3 denotes an internal gear rotated by a second drive unit (not shown), numeral 4 denotes a sun gear rotated by a third drive unit (not shown), numeral 5 denotes materials to be processed, numeral 6 denotes columns, numeral 7 denotes a suspension plate 7, numeral 8 denotes a universal joint, numeral 9 denotes an annular upper surface plate, numeral 10 denotes a drive shaft rotated by a fourth drive unit (not shown), and numeral 11 denotes drive keys mounted in the key grooves 10*a* of the drive shaft 10 for coupling the upper surface plate 9 with the drive shaft 10.

When the parallel-surface processing machine operates, the plurality of carriers 2 are radially disposed on the lower surface plate 1 via meshing engagement thereof with the internal gear 3 and the sun gear 4, and the materials to be processed 5 as workpieces are mounted in the plurality of workpiece holding holes of the carriers 2. Furthermore, the upper surface plate 9, which is suspended like a pendulum by the universal joint 8 via components such as the columns 6, suspension plate 7 and the like, is lowered by a pressure adjustment mechanism such as, for example, an air cylinder or the like (not shown) so as to apply a proper load on the materials to be processed 5 which are mounted on the carriers 2. Furthermore, the drive keys 11 mounted on the upper surface plate 9 are coupled with the drive shaft 10. The key grooves 10*a* of the drive shaft 10 are disposed vertically so that a drive force can be transmitted from the key grooves 10*a* of the drive shaft 10 to the drive keys 11 while the drive keys 11 are permitted to move vertically. With this arrangement, the upper surface plate 9 naturally descends by gravity while engaging the materials to be processed 5 even after the drive keys 11 are coupled with key groove 10*a* of drive shafts 10. A support shaft attached to the universal joint 8 is arranged so as to be rotatable via a bearing (not shown), and the upper surface plate 9 is also rotated by the rotation of the drive shaft 10.

When the materials to be processed 5 are being polished, the lower surface plate 1 and the upper surface plate 9 are rotated in opposite directions while abrasive grains are supplied from an abrasive grain supply hole (not shown) disposed at the upper surface plate 9. Furthermore, the rotation of the internal gear 3 and the sun gear 4 causes the carriers 2, on which the materials to be processed 5 are mounted and clamped between the lower surface plate 1 and the upper surface plate 9, to rotate about their own axes as well as to revolve around the outside of the sun gear 4 so that both surfaces of the materials to be processed 5 are polished. Since the rotations of the lower surface plate 1, the internal gear 3, the sun gear 4, and the upper surface plate 9 are controlled by the first, second, third, and fourth drive units, their rotation speeds are adjusted so that the materials to be processed 5 can be polished optimally. Note that the term "polishing" used here is a generic term which means processing executed using abrasive grains such as lapping, polishing, grinding, and the like. The parallel-surface processing machine shown in FIG. 4 and 5 is referred to as a 4-way-type parallel-surface processing machine because it is composed of elements which perform four motions including the rotation of the lower surface plate 1, the rotation of the upper surface plate 9, the rotation of the carriers 2 about their own axes, and the revolution of the carriers 2 around the sun gear 4.

Recently in the mobile telecommunications industry, since there is a trend toward the use of progressively higher frequencies, it is desired to provide resonators and filters, which are main components of mobile telecommunications equipment, which are suitable for the higher frequencies. These components are typically made of dielectric ceramics such as lead zirconate titanate, lead titanate, etc., in addition to ferroelectric single crystals such as quartz, lithium niobate, lithium tantalate, etc. To permit these components to be used at high frequencies, the thicknesses of the substrates for the resonator and for the filter must be further reduced. However, the following problems arise when the thickness of the substrate is further reduced and the conventional 4-way parallel-surface processing machine is used.

(1) In FIGS. 4 and 5, when the upper surface plate 9 is rotated by coupling the drive keys 11 with the drive shaft 10, the drive keys 11 cannot be moved in the vertical direction because the dynamic frictional forces between the key grooves 10*a* of the drive shaft 10 and drive keys 11 at the coupling sections are increased by being affected by the inertial force caused by the moment of inertia of the upper surface plate 9. Thus, the upper surface plate 9 cannot be automatically lowered by gravity even if the thickness of the materials to be processed 5 is reduced because it is held by the coupling sections.

(2) The lower surface plate 1 is not maintained in parallel with the upper surface plate 9 due to the displacement of the center of the upper surface plate 9 at which it is supported (center of the universal joint 8) from the center of the three coupling sections where the upper surface plate 9 is coupled with the drive shaft 10 via the drive keys 11.

(3) Therefore, the upper surfaces and the lower surfaces of the materials to be processed 5 cannot be polished in parallel with each other. Furthermore, forces are unevenly applied to the materials to be processed 5 from above and below, depending upon the locations of the materials, whereby the materials 5 to be processed may be chipped or cracked.

SUMMARY OF THE INVENTION

Thus, it is an object of the present invention to solve the above problems by employing a mechanism to prevent rotation of the upper surface plate while rotating the lower surface plate to avoid effects resulting from the moment of inertia caused by the rotation of the upper surface plate so that the upper surface plate can be easily and automatically lowered by gravity by avoiding the situation in which dynamic frictional resistance is increased between the key grooves 10*a* of the drive shaft 10 and the drive keys 11 at the coupling sections.

In addition to the above object, another object of the present invention is to provide a 3-way planetary-gear-type parallel-surface processing machine by which an upper surface plate is maintained in parallel with a lower surface plate at all times by enhancing the ability of the upper surface plate to follow the surfaces of materials to be processed by suspending the upper surface plate by a wire capable.

That is, a planetary-gear-type parallel-surface processing machine of the present invention disposes a plurality of carriers, each of which has a toothed surface formed around the outer periphery thereof and a plurality of workpiece holding holes formed thereat in a rotational direction, on a lower surface plate as well as causes the plurality of carriers to mesh with a sun gear and an internal gear which are disposed on a horizontal plane, thereby forming a planetary gear train. Then, after workpieces are inserted into the workpiece holding holes of the carriers, an upper surface plate is lowered so as to clamp both surfaces of the carriers between the upper surface plate and the lower surface plate, and the sun gear and the internal gear are rotated. With this arrangement, the carriers are caused to execute a planetary motion, and at the same time, the lower surface plate and the upper surface plate are rotated relative to the carriers, whereby the workpieces are lapped or polished.

The planetary-gear-type parallel-surface processing machine has at least one rotation preventing pin standing on the upper surface of the upper surface plate at a position proximate to the outer periphery thereof, a stopper supported by a machine main body for stopping the rotation of the upper surface plate by abutment against a side of the rotation preventing pin, a support member fixed to the upper surface plate, a first pulley group supported by a plurality of rotating shafts projecting from a side the support member, a suspension plate movable vertically, a second pulley group supported by a plurality of rotating shafts projecting from a side of the suspension plate, and an endless wire cable stretched between the pulleys constituting the first pulley group and the pulleys constituting the second pulley group so as to equally support the vertical load of the upper surface plate.

Furthermore, the planetary-gear-type parallel-surface processing machine of the present invention includes a rotation control device for controlling the rotation speed of the sun gear, and for controlling the internal gear and the lower surface plate so that the speeds of the upper surface plate and the lower surface plate, which are abutted against the upper surfaces and the lower surfaces of the carriers, relative to the carriers, are made to be substantially the same relative speed when the upper surface plate is maintained in a stationary state.

DESCRIPTION OF THE PREFERRED EMBODIMENT

An embodiment of the present invention will be described below with reference to the accompanying drawings.

Figure 1:
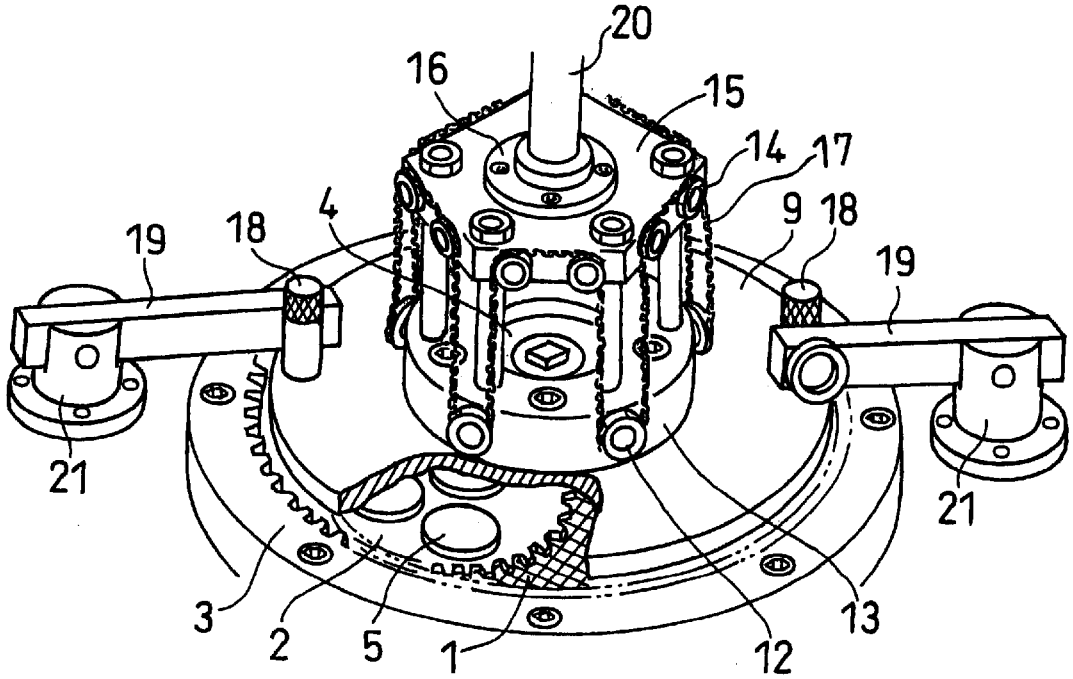
FIG. 1 is a perspective view showing the main portion of an embodiment of the present invention.
Figure 2:
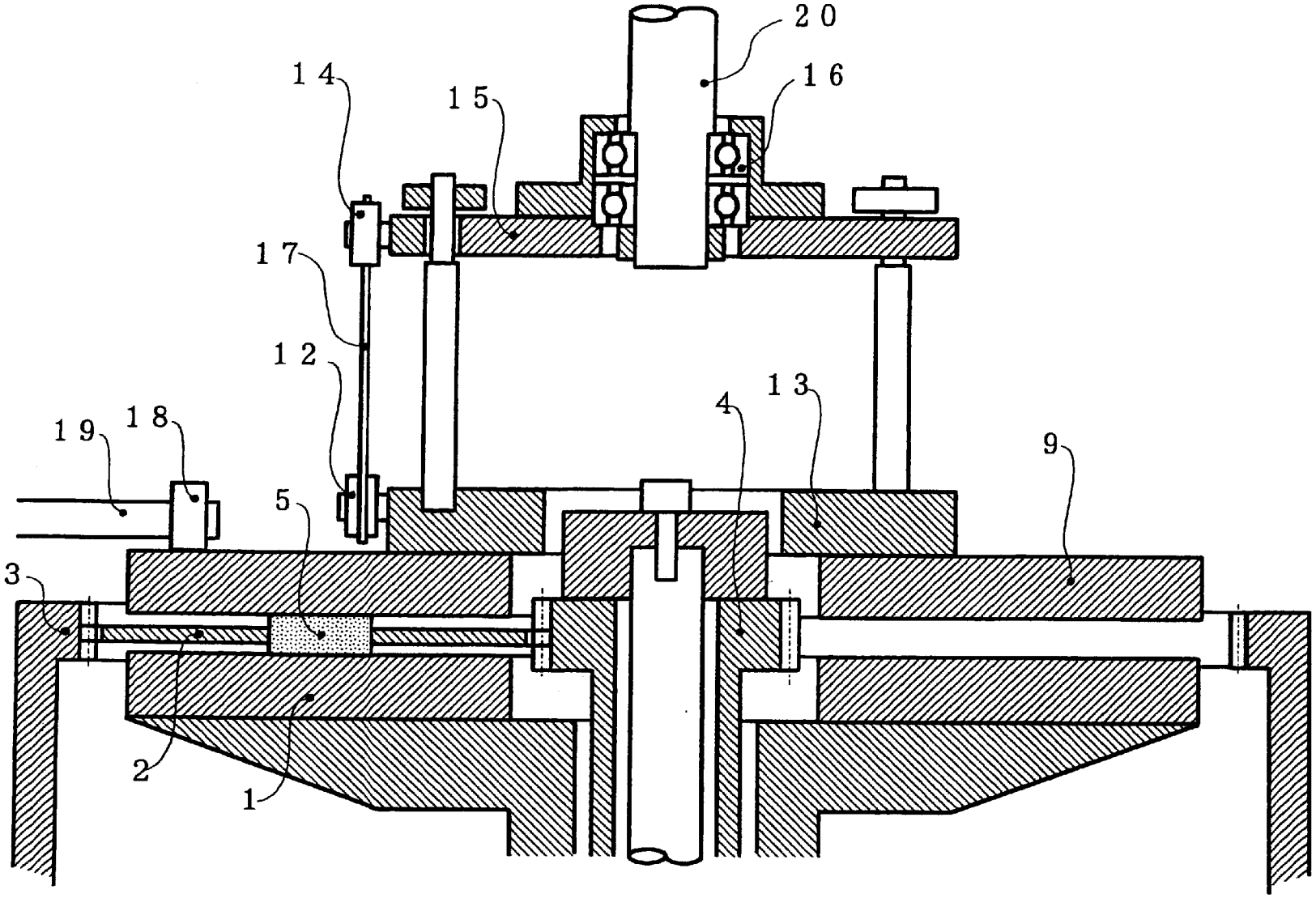
FIG. 2 is a sectional view of the main portion of the embodiment of the present invention.

FIG. 1 is a perspective view showing the main portion of an embodiment of a planetary-gear-type parallel-surface processing machine according to the present invention; and FIG. 2 is a sectional view of the main portion thereof. Numeral 1 denotes a lower surface plate rotated by a first drive unit (not shown), numeral 2 denotes a plurality of carriers radially disposed on the lower surface plate 1, numeral 3 denotes an internal gear meshed with the toothed surfaces of the outer peripheries of the carriers 2 as well as rotated by a second drive unit (not shown), numeral 4 denotes a sun gear meshed with the teeth of the outer peripheries of the carriers 2 as well as rotated by a third drive unit (not shown), numeral 5 denotes a plurality of materials to be processed which are mounted in workpiece holding holes formed at the carriers 2 and subjected to lapping or polishing, numeral 9 denotes an upper surface plate, numeral 12 denotes pulleys constituting a first pulley group, numeral 13 denotes a ring formed in an annular shape as an example of a support member of the present invention, numeral 14 denotes pulleys constituting a second pulley group, numeral 15 denotes a pentagonal suspension plate, numeral 16 denotes a bearing disposed at the center of the suspension plate 15, numeral 17 denotes a wire cable 17 stretched between the pulleys 12 and 14, numeral 18 denotes pins standing on the upper surface plate 9, numeral 19 denotes stoppers, numeral 20 denotes the extreme end of a rod of an air cylinder supported by the bearing 16, and numeral 21 denotes brackets.

The parallel-surface processing machine will be specifically described below.

The ring 13 is concentrically fixed on the upper surface of the upper surface plate 9 integrally therewith at a position near the inner periphery of the upper surface plate 9, and the five pulleys 12 are mounted around the outer peripheral surface of the ring 13 at equal intervals via horizontal rotational shafts. The pentagonal suspension plate 15 is rotatably supported at the extreme end 20 of the rod through the bearing 16 above the ring 13. Each pair of sets of two pulleys 14 is mounted to respective sides of the outer peripheral surface of the suspension plate 15 via horizontal rotating shafts; that is, a total of ten sets of pulleys 14 are mounted on the suspension plate 15. The wire cable 17, which is formed so as to be endless by coupling the two ends thereof together, is stretched between the pulleys 12 of the ring 13 and the pulleys 14 of the suspension plate 15. The ring 13 and the upper surface plate 9 are suspended from the suspension plate 15 by the wire cable 17 by equal forces.

Two sets of the pins 18 stand on the upper surface of the upper surface plate 9 at positions near the outer periphery of the upper surface plate 9 so as to face each other. Furthermore, the stoppers 19 are supported by the brackets 21 attached to a processing machine main body (not shown) integrally therewith so as to swing vertically. The stoppers 19 are abutted against sides of the pins 18 by lowering the extreme ends thereof onto the upper surface plate 9.

Since the upper surface plate 9 is suspended by the wire cable 17 at a plurality of positions at equal intervals in a rotational direction as described above, the upper surface plate 9 is stably held at a position at which it is parallel with a horizontal plane. Even if the materials to be processed 5 are polished and the levels of the upper surfaces thereof are lowered, the upper surface plate 9 is automatically lowered by gravity, whereby the lower surface of the upper surface plate 9 closely follows the upper surfaces of the materials to be processed 5 and is in intimate contact therewith. In the embodiment, the upper surface plate 9 can be suspended as described above without the need to take centrifugal force into consideration because the upper surface plate 9 is not rotated.

Note that the motion of the upper surface plate 9 may be restrained so that it moves only vertically in addition to the support of the ring 13 and the suspension plate 15 by the wire cable 17, in order to reliably maintain the upper surface plate 9 in parallel with the lower surface plate 1 even when the upper surface plate 9 moves vertically.

The plural carriers 2 are disposed on the upper surface of the annular lower surface plate 1 by being equally separated and meshed with the internal gear 3 and the sun gear 4. The plurality of the materials to be processed 5 as the workpieces are mounted in the workpiece holding holes formed in the carriers 2. The condition of the load applied from the upper surface plate 9 on the materials to be processed 5 can be maintained in an optimum state by lowering the upper surface plate 9 onto the materials to be processed 5 by operating the air cylinder and adjusting the position of the suspension plate 15 in the vertical direction. When the three shafts of the internal gear 3, the sun gear 4, and the lower surface plate 1, excluding the upper surface plate 9, are rotated at predetermined rotation speeds, by respectively driving the first, second, and third shafts (none are shown), the carriers 2 execute planetary motions as well as the upper surface plate 9 and the lower surface plate 1, which press the upper and lower surfaces of the materials to be processed 5, rotate relatively to and slide thereon, whereby the polishing of the upper and lower surfaces of the materials to be processed 5 is started.

Note that while a force is applied on the materials to be processed 5 by the upper surface plate 9 by the revolution of the carriers 2 so as to rotate the upper surface plate 9 in the same direction, the rotation is prevented by the pins 18 abutted against the stoppers 19. As a result, the upper surface plate 9 is maintained in a stationary state.

In actual polishing, only the lower surface plate 1 is rotated the upper surface plate 9 is not rotated, abrasive grains are supplied through an abrasive grain supply hole (not shown) disposed at the upper surface plate 9; at the same time, the internal gear 3 and the sun gear 4 are rotated at different angular speeds, whereby the carriers 2 are rotated about their own axes as well as are revolved around the sun gear 4.

In the present invention, both surfaces of the materials to be processed 5 are polished in such a manner that the carriers 2, to which the materials to be processed 5 are mounted, execute planetary motions while being clamped between the lower surface plate 1 and the upper surface plate 9 under pressure. That is, in the embodiment, since the materials to be processed 5 are machined by a combination of three motions of the elements, which are the rotation of the lower surface plate 1, the rotation of the carriers 2, and the revolution of the carriers 2, the parallel-surface processing machine is referred to as a "3-way parallel-surface processing machine".

Figure 3A:
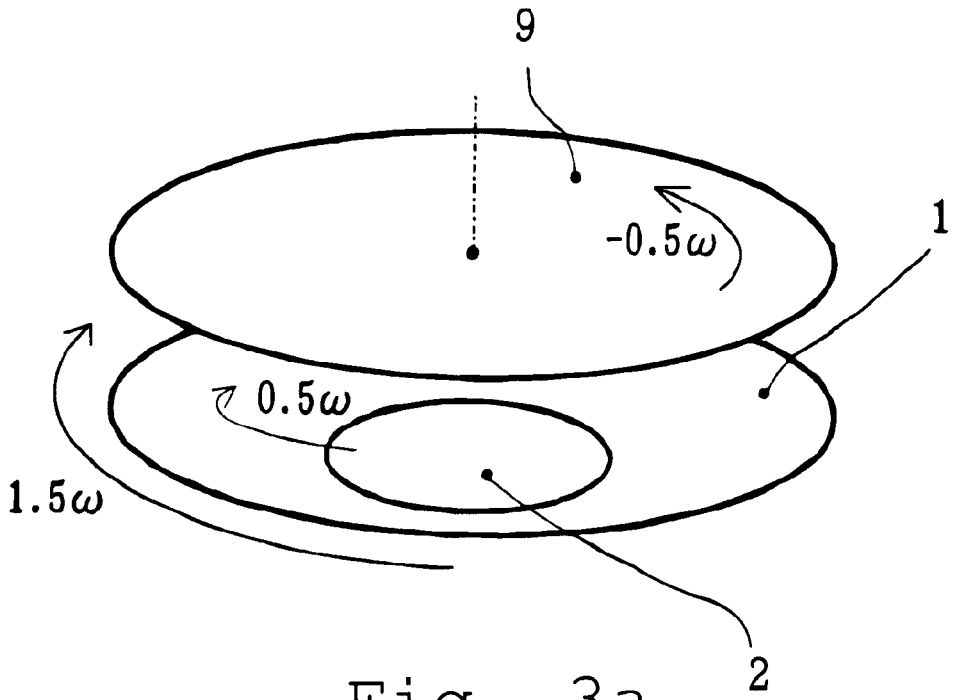
FIG. 3 is a view explaining the speed control for an upper surface plate, a lower surface plate, and carriers of the embodiment of the present invention.

In the embodiment, the rotation speed of the upper surface plate 9 is made to be zero because the rotation thereof is stopped by the abutment of the stoppers 19 against the pins 18. However, processing similar to that of the conventional 4-way-type parallel-surface processing machine can be realized by adjusting the rotation speed of the lower surface plate 1 and the revolution speed of the carriers 2. The speed adjustment will now be described. FIG. 3 is a view explaining the speed control of the lower surface plate 1, the upper surface plate 9, and the carriers 2. Note that the rotation of the carriers 2 is not taken into consideration in order to simplify the explanation. For example, when the relative speed between the revolution speed of the carriers 2 and the rotation speed of the lower surface plate 1 is made equal to the relative speed between the revolution speed of the carriers 2 and the rotation speed of the upper surface plate 9, the behavior of the conventional 4-way parallel-surface processing machine is as shown in, for example, FIG. 3A.

That is, when the upper surface plate 9 is rotated counterclockwise at an angular speed $-0.5\ \omega$ and the carriers 2 are revolved clockwise at an angular speed $0.5\ \omega$, the upper surfaces of the materials to be processed 5 come into contact with the upper surface plate 9 at an angular speed $\omega$ with reference to the materials to be processed 5. Similarly, when the lower surface plate 1 is rotated clockwise at an angular speed $1.5\ \omega$ and the carriers 2 are revolved clockwise at an angular speed $0.5\ \omega$, the lower surfaces of the materials to be processed 5 come into contact with the lower surface plate 1 at an angular speed $-\omega$.

Figure 3B:
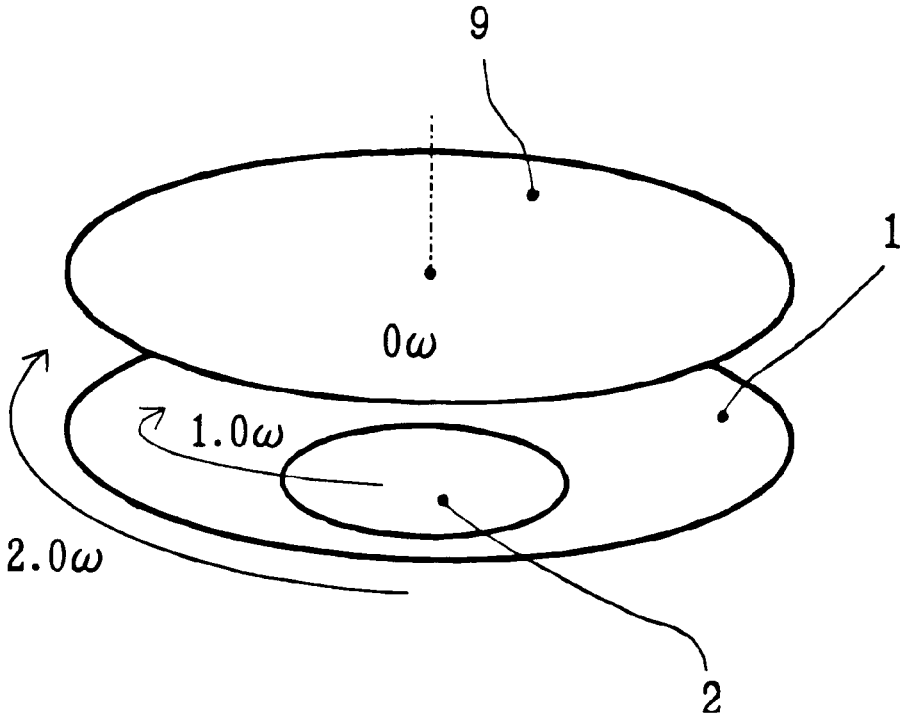

When, for example, the carriers 2 are revolved clockwise at an angular speed $\omega$ with respect to the upper surface plate 9 (which is not rotated) as shown in, for example, FIG. 3B, in order to realize processing similar to that of the 4-way-type parallel-surface processing machine using the 3-way-type parallel-surface processing machine of the embodiment, the upper surfaces of the materials to be processed 5 come into contact with the upper surface plate 9 at an angular speed w relative to the materials to be machined. Similarly, when the lower surface plate 1 is rotated clockwise at an angular speed $2\ \omega$ and the carriers 2 are revolved clockwise at an angular speed $\omega$, the lower surfaces of the materials to be processed 5 come into contact with the lower surface plate 1 at an angular speed $-\omega$ -relative to the materials to be processed 5.

As described above, as to the speed of the materials to be processed 5 relative to the lower surface plate 1, the 3-way-type parallel-surface processing machine of the embodiment can produce effects similar to those of the conventional 4-way-type parallel-surface processing machine by adjusting the rotation speeds of the lower surface plate 1, the internal gear 3, and the sun gear 4.

Figure 4:
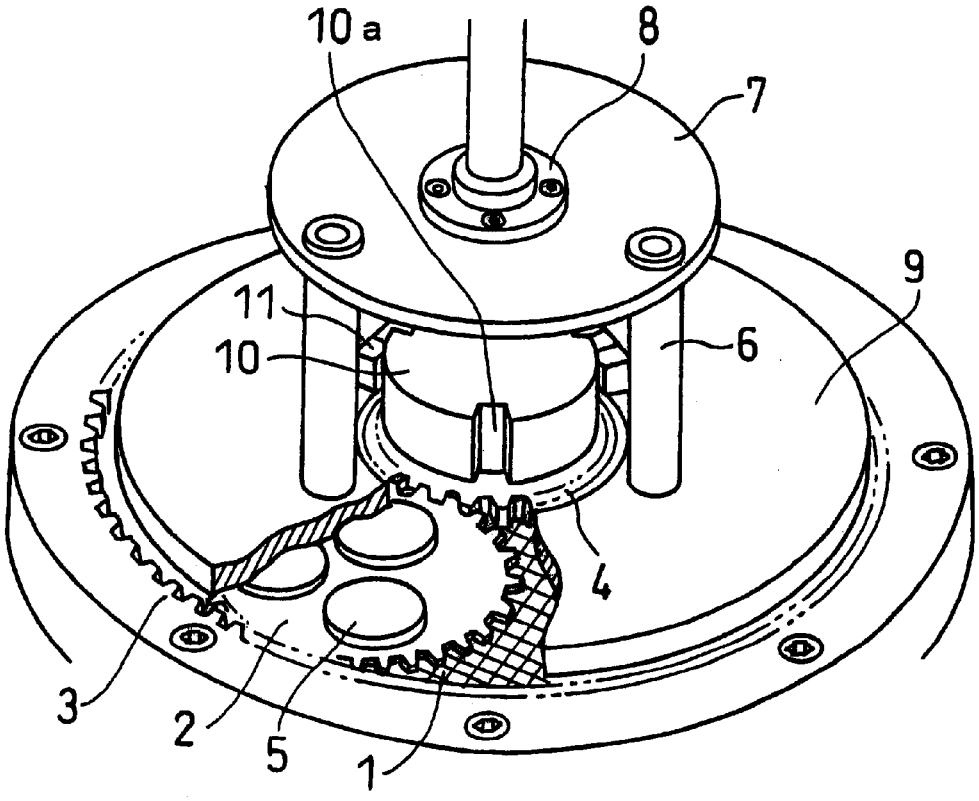
FIG. 4 is a perspective view showing a conventional example.
Figure 5:
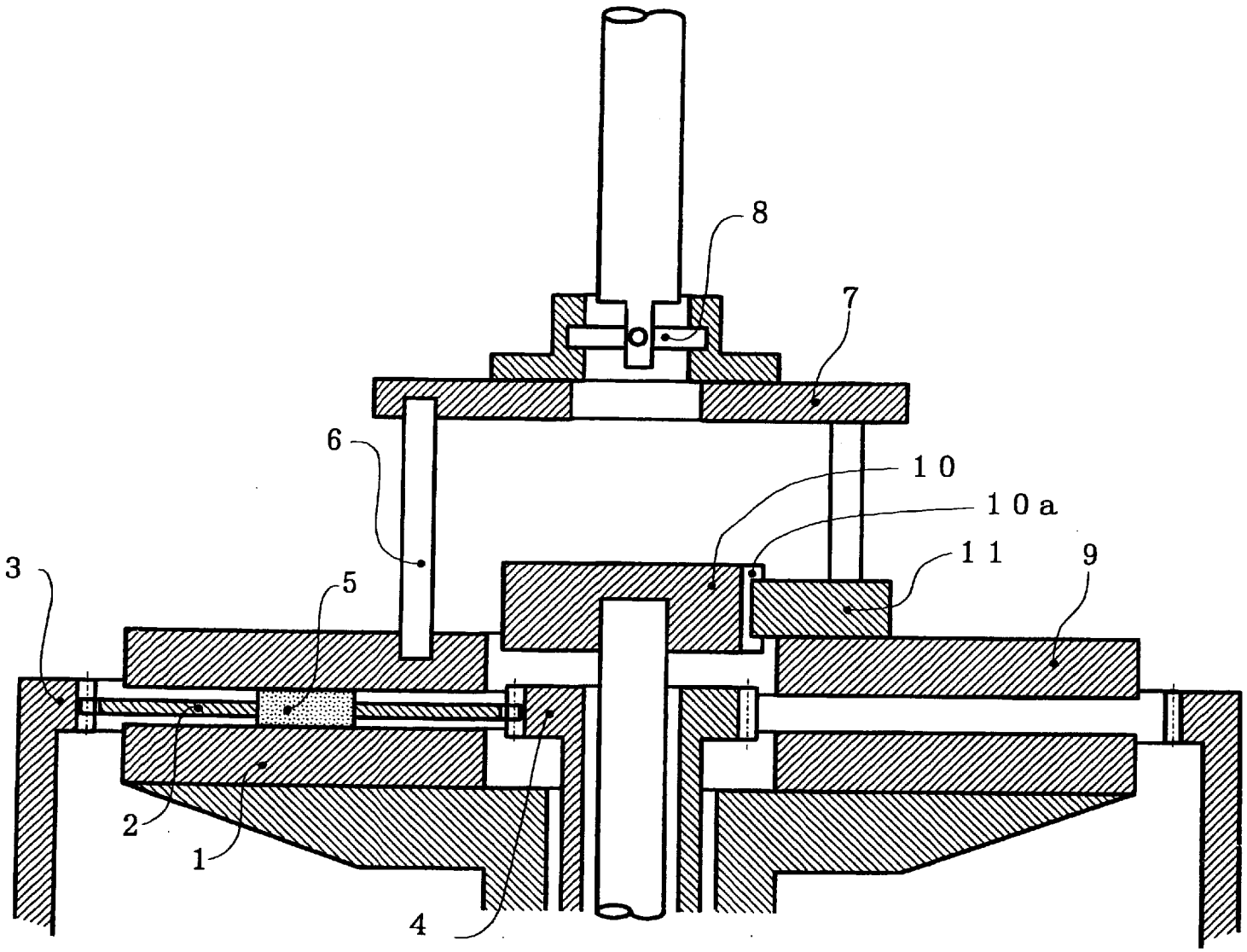
FIG. 5 is a sectional view of the conventional example.

As described above, according to the present invention, a mechanism is employed so as not to rotate the upper surface plate 9 while the lower surface plate 1 is rotated to avoid effects resulting from moment of inertia caused by the rotation of the upper surface plate. Accordingly, the upper surface plate can be easily and automatically lowered by gravity by avoiding the situation in which dynamic frictional resistance is increased between the key groove 10*a* of the drive shaft 10 and the drive key 11 at the coupling section shown in FIGS. 4 and 5.

In addition to the above arrangement, since the upper surface plate 9 is suspended by the wire cable 17, the ability of the upper surface plate 9 to follow the surfaces of materials to be processed 5 is enhanced, whereby the 3-way-type planetary-gear parallel-surface processing machine, which permits the upper surface plate 9 to be maintained in parallel with the lower surface plate 1 at all times, can be provided.

As a result, an ultra-thin product may be produced composed of a brittle material such as lead zirconate titanate, lead titanate, etc., in addition to quartz, lithium niobate, lithium tantalate, etc., by subjecting the material to parallel surface polishing.

As described above, the planetary-gear-type parallel-surface processing machine according to the present invention is suitable for performing surface processing such as lapping, polishing, and the like.

What is claimed is:

1. A surface processing machine comprising:

an upper surface plate;

a lower surface plate;

a plurality of carriers meshed with a sun gear and an internal gear disposed in a horizontal plane, each of the carriers having a toothed surface formed around the outer periphery thereof and a plurality of workpiece holding holes formed therein, the carriers executing planetary motions by rotating the sun gear and the internal gear with the front and back surfaces of the carriers clamped between the lower surface plate and the upper surface plate, vertical movement of the upper surface plate being performed with simultaneous relative movement of the lower surface plate and the upper surface plate with respect to the carriers;

at least one rotation preventing pin disposed on the upper surface of the upper surface plate in proximity to the outer periphery thereof;

a stopper supported by a machine main body for stopping the rotation of the upper surface plate by abutment against a side of the rotation preventing pin;

a support member fixed to the upper surface plate;

a first pulley group supported by a plurality of rotating shafts projecting from a side the support member;

a suspension plate movable in vertical direction;

a second pulley group supported by a plurality of rotating shafts projecting from a side of the suspension plate; and an endless wire cable stretched between the pulleys of the first pulley group and the pulleys of the second pulley group so as to equally support the vertical load of the upper surface plate.

2. A surface processing machine according to claim 1, further comprising a rotation control device for controlling the rotation speeds of the sun gear, the internal gear, and the lower surface plate, the speeds of the upper surface plate and the lower surface plate, relative to the carriers being the same relative speed when the upper surface plate is stationary.

* * * * *